United States Patent [19]

Notta

[11] 4,392,787

[45] Jul. 12, 1983

[54] DIAPHRAGM PUMP

[75] Inventor: Adolf Notta, Youngstown, N.Y.

[73] Assignee: Wetrok Inc., Niagara Falls, N.Y.

[21] Appl. No.: 226,830

[22] Filed: Jan. 21, 1981

[51] Int. Cl.[3] ..... F04B 1/18; F04B 35/02

[52] U.S. Cl. ..... 417/269; 417/388

[58] Field of Search ..... 417/269, 271, 385, 366, 417/388, 389, 500

[56] References Cited

U.S. PATENT DOCUMENTS

| | | | |
|---|---|---|---|
| Re. 29,055 | 11/1976 | Wagner . | |
| 1,238,939 | 9/1917 | Pfeeger | 417/500 |
| 2,424,943 | 7/1947 | Nicolls . | |
| 2,582,157 | 1/1952 | Pica | 417/500 |
| 3,068,798 | 12/1962 | Machen . | |
| 3,374,750 | 3/1968 | Hetz . | |
| 3,476,053 | 11/1969 | Czarnecki et al. . | |
| 3,680,981 | 8/1972 | Wagner . | |
| 3,712,758 | 1/1973 | Lech | 417/214 |
| 3,775,030 | 11/1973 | Wanner | 417/388 |
| 3,884,598 | 5/1975 | Wanner | 417/386 |
| 4,068,982 | 1/1978 | Quarve . | |

FOREIGN PATENT DOCUMENTS

| | | | |
|---|---|---|---|
| 1498329 | 1/1969 | Fed. Rep. of Germany | 417/389 |
| 2923284 | 1/1980 | Fed. Rep. of Germany | 417/388 |

*Primary Examiner*—William L. Freeh

*Attorney, Agent, or Firm*—Christel, Bean & Linihan

[57] ABSTRACT

A diaphragm pump having a reciprocating piston, a rotatable cam canted and engaging the piston, and a diaphragm secured to a plunger stem by a screw rotatable relative to the stem. The plunger stem extends into a bore in the piston, the piston bore and plunger stem having a matching configuration preventing rotation of the plunger stem relative to the piston when the diaphragm securing screw is loosened. The piston end engaging the cam is formed as a spherical section positioning the line of engagement with the cam closely adjacent the axial center of the piston, to reduce side thrust.

4 Claims, 3 Drawing Figures

Fig. 1.
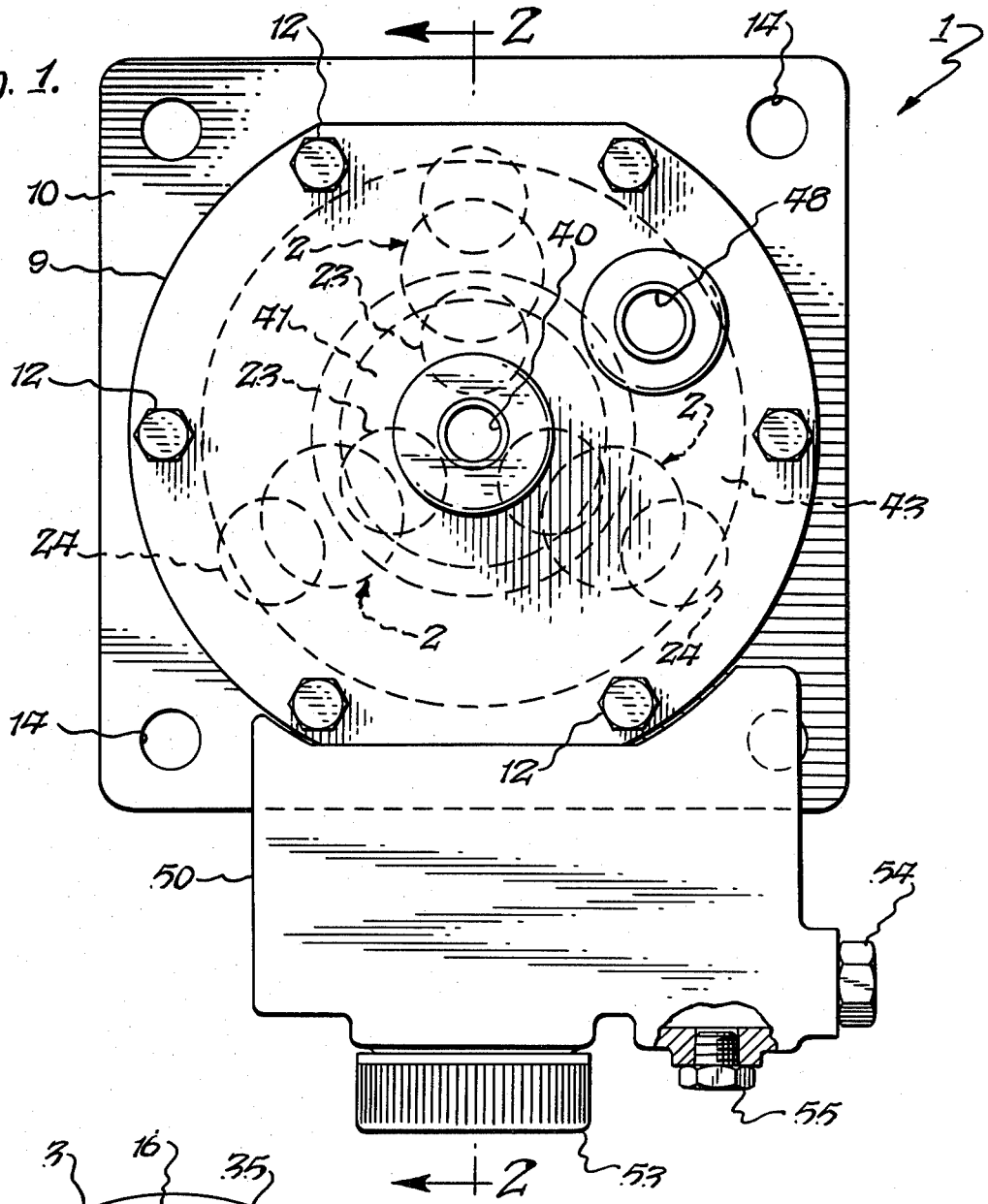
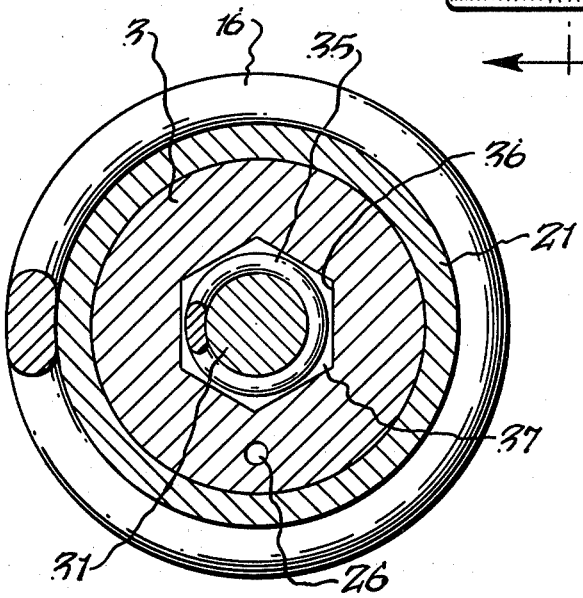
Fig. 3

DIAPHRAGM PUMP

BACKGROUND OF THE INVENTION

This invention relates generally to the pump art, and more specifically to certain new and useful improvements in diaphragm pumps of the type disclosed in U.S. Pat. Nos. 3,775,030, 3,884,598 and 3,953,154.

Diaphragm pumps of the type disclosed in these patents have a series of piston assemblies which are reciprocated by a rotating cam, the cam being canted to translate its rotation into reciprocation of the pistons. A diaphragm assembly is associated with each piston assembly, and includes a diaphragm separating a pumping chamber from a transfer chamber, the latter being between the diaphragm and piston and containing hydraulic fluid for transmitting pumping force through the diaphragm to the pumping chamber. The diaphragm is mounted on a plunger having a stem extending into a bore within the piston, the diaphragm being secured to the plunger stem by a screw.

SUMMARY OF THE INVENTION

A primary object of this invention is to provide a diaphragm pump of the foregoing type having means preventing rotation of the piston stem to permit loosening of the screw and removal of the diaphragm.

Another object of this invention is to provide a diaphragm pump of the foregoing type wherein the line of engagement between the cam and the piston is closely adjacent the piston axis, to reduce lateral thrust against the piston.

The foregoing and other objects and advantages of this invention will become apparent from the following detailed description in conjunction with the accompanying drawings wherein like reference numerals denote like parts throughout the various views.

DESCRIPTION OF THE DRAWING FIGURES

FIG. 1 is a front end elevational view of a pump of this invention, the pump being shown inverted from its normal position in use;

FIG. 3 is a transverse sectional view of a piston assembly, taken about on line 3—3 of FIG. 2, on an enlarged scale.

DETAILED DESCRIPTION OF THE ILLUSTRATED EMBODIMENT

Figure 2:
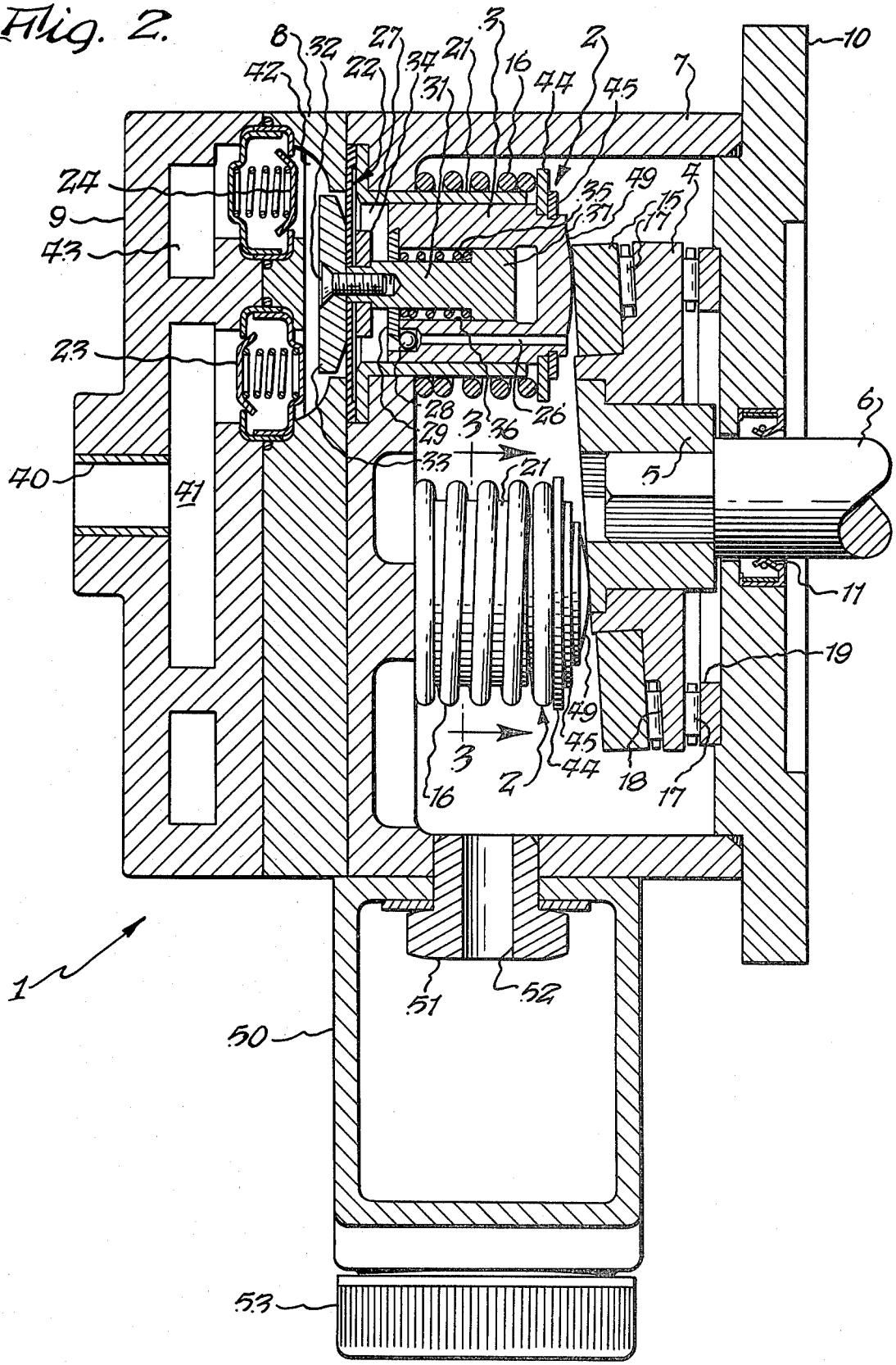
FIG. 2 is an axial sectional view thereof, taken about on line 2—2 of FIG. 1 on an enlarged scale.

Referring to accompanying drawing there is shown a diaphragm pump of the present invention, generally designated 1, including three piston assemblies each generally designated 2. Each piston assembly includes a piston 3 adapted to be reciprocated by a cam 4 mounted on a sleeve 5, the latter having a hexagonal base receiving the correspondingly shaped end of a drive shaft 6 for rotation therewith.

The pump case includes a body 7 for the piston assemblies and cam, a valve plate section 8 defining the pumping chambers and containing the discharge valve assemblies, a manifold end section 9 and adapter plate and section 10. Drive shaft 6 extends through a central opening in plate 10 with a suitable seal 11 therebetween. Body 7, plate 8 and manifold 9 are secured together by bolts 12 (FIG. 1), and plate 10 is secured to body 7 by any suitable means, such as similarly arranged bolts, not shown. Plate 10 also includes openings 14 for mounting pump 1 on its drive motor or any suitable mounting bracket.

Each piston 3 is biased against the bottom surface of an annular stationary cam plate 15 by a spring 16. Bearings 17 are disposed between the canted inner surface 18 of cam 4 and cam plate 15, and also between the outer face of cam 4 and a thrust washer 19 mounted on the adapter plate 10.

Each piston assembly 2 also includes a cylindrical piston sleeve 21 and is associated with a diaphragm assembly including diaphragm 22, and a valve assembly including an inlet or suction valve 23 and an outlet or discharge valve 24. Each piston assembly, diaphragm assembly and valve assembly is identical to the other such assembly, whereby only one is shown and described in detail. The piston sleeves 21 are secured in position within body 7, the pistons 3 reciprocating therein, and a transfer chamber 27 is defined between each diaphragm 22 and the inner end of the associated piston 3. The pump body 7 is adapted to be filled with hydraulic fluid, and each piston 3 has a passage 26 parallel to the piston axis for admitting hydraulic fluid to the transfer chamber 27 under control of a ball check valve 28, the latter being held captive within the enlarged inner end of bore 26 by a retainer washer 29 secured in the inner end of the piston body.

Diaphragm 22 is secured between the valve plate 8 and the flanged end of piston sleeve 21, and is secured to a plunger stem 31 by a screw 32 which is threaded into the end of stem 31. Screw 32 also secures a follower 33 to stem 31. A plunger 34 is apertured to fit over the reduced end of plunger stem 31, against the shoulder formed thereby, and diaphragm 22 is secured between plunger 34 and follower 33. A spring 35 is secured within the bore 36 of piston 3, extending between retainer 29 and the laterally enlarged, flanged inner end 37 of plunger stem 31. A pump chamber 42 is defined by plate 8 on the side of diaphragm 22 opposite transfer chamber 27.

The fluid to be pumped is admitted to the pump case through a central inlet 40 to an inlet chamber 41, passes spring check valves 23 to pump chambers 42 during the suction stroke of the piston and from pump chamber 42 through spring check valve 24 to a discharge chamber 43 during the pumping or discharge stroke of the piston, it being understood that the inlet and outlet or discharge can be reversed.

A reservoir tank 50 is secured to pump body 7 by a fitting 51 having a passage 52 placing tank 50 in communication with the interior of body 7. Cap 53 (FIG. 1) normally closes a fill opening in tank 50, for filling body 7 and tank 50 with hydraulic fluid, and a service filling opening in tank 50 is normally closed by a plug 54. A small amount of air is trapped within tank 50 (the pump being inverted from the illustrated position when in use) to accommodate expansion of the hydraulic fluid while maintaining such trapped air removed from the body 7 and the transfer chambers 27. A breathing fitting 55 is provided with the end wall of tank 50 which will be upright during normal use.

The operation of the pump will become apparent from the foregoing and reference may be had to the aboveidentified patents for a further description. For purposes of understanding this disclosure, it is sufficient to note that as the cam rotates it reciprocates the pistons 3 in sequence. During the discharge stroke of the piston diaphragm 22 is moved into pump chamber 42, the hydraulic fluid in transfer chamber 27 transferring the reciprocating piston force to the diaphragm, causing the latter to force fluid through discharge valve 24 to the discharge chamber 43 and through outlet 48. During this stroke, ball check valve 28 prevents passage of hydraulic fluid from transfer chamber 27 through passage 26, although a very limited amount of fluid passes between piston 3 and sleeve 21 for purposes of lubrication. When the cam plate 15 retreats, spring 16 biases piston 3 to follow the retreating cam plate, acting through a washer 44 secured to the end of piston 3 by a retainer ring 45. During this suction stroke, the spring 35 biases diaphragm 22 to follow the piston, with limited relative motion there between admitting hydraulic fluid to the transfer chamber, as more fully described in the above referenced patents.

When any diaphragm 22 requires replacement, bolts 12 are removed to permit removal of manifold 9 and plate 8, exposing the diaphragm assemblies. Screws 32 is loosened to separation the diaphragm from the plunger stem, new diaphragm is positioned on the stem, and the follower 34 and screw 32 are secured against the diaphragm and to the plunger stem, restoring the assembly to operative position. It is a particular feature of this invention that even if screw 32 is tightly engaged in the plunger stem it can be loosened without need for grasping stem 31 on the transfer chamber side of the diaphragm. This is accomplished by the provision of a piston bore 36 having a sidewall configuration coacting with the sidewall configuration of stem flange 37 in a manner preventing relative rotation therebetween. As seen in FIG. 3, the piston bore wall 36 and stem flange 37 can be of hexagonal configuration. This permits relative reciprocation. However, it prevents relative rotation, something which spring 35 does not have sufficient strength to do. Spring 16, on the other hand, is relatively much stronger, and does prevent rotation of piston 3. As a result, the piston assembly and plunger stem are held against rotation as screw 32 is loosened.

It is another feature of this invention that pistons 3 are reciprocated by the canted cam with a minimum of lateral thrust. It will be appreciated that because the cam 4 is inclined, or canted relative to its axis of rotation and to the parallel axes of reciprocation of the pistons, the force exerted against the piston by the rotating cam includes a laterally directed component. This can cause wear, and therefore is undesirable.

In accordance with this invention, such lateral thrust is reduced to a minimum by shaping the end of the piston which engages cam plate 15 as a spherical section, as shown at 49, the spherical dome shaped end being formed on a radius so designed as to position the line of engagement between the piston end 49 and cam plate 15 closely adjacent the axial center of the piston end 49. The dome or spherical radius will vary depending upon the radial distance from the axis of rotation of the cam. By spherically shaping the piston end in the manner shown, the line of engagement with cam plate 15 is very close to the center of the end 49, and the thrust of the cam against the piston is primarily axial, with minimal side thrust.

Accordingly, it is seen that this invention fully accomplishes its intended objects. It will be appreciated that the foregoing detailed description is intended to be illustrative, and not limiting, and that the scope of the invention is to be defined by the appended claims.

What is claimed is:

1. In a diaphragm pump of the type having a pump housing, a piston reciprocal within said housing, cam means operatively engaging said piston for reciprocating the same, a diaphragm disposed between said piston and a pumping chamber within said housing, a plunger stem secured to said diaphragm by screw means rotatable relative to said stem, said piston having a bore and said plunger stem having an end portion extending into said bore, said stem end portion defining a surface slidably engaging the wall of said bore, the improvement comprising:

(a) said engaging surface of said plunger stem end portion and the wall of said piston bore coacting to prevent relative rotation therebetween upon rotation of said screw means relative to said stem to disengage said stem from said diaphragm, and (b) means constraining said piston against rotation upon such rotation of said screw means.

2. A diaphragm pump as set forth in claim 1, together with first means biasing said plunger stem end portion into said piston bore, and second means biasing said piston toward said cam means, said second biasing means constraining said piston against rotation upon rotation of said screw means relative to said stem.

3. A diaphragm pump as set forth in claim 1 or claim 2, said plunger stem end portion and the wall of said bore being of flat-sided configuration to preclude relative rotation while permitting axial reciprocation therebetween.

4. A diaphragm pump as set forth in claim 1 or claim 2, said cam means comprising a rotatable cam canted relative to its axis of rotation, said piston having a spherical section engaging a small surface area of said rotatable cam, said spherical section being formed on a radius selected to position the area of engagement against said cam means closely adjacent the axis of reciprocation of said piston to reduce lateral thrust there against.

* * * * *